US011685571B2

(12) United States Patent
Garthaffner

(10) Patent No.: US 11,685,571 B2
(45) Date of Patent: Jun. 27, 2023

(54) METHOD OF USING BLANK WITH FOOT PANEL

(71) Applicant: Altria Client Services LLC, Richmond, VA (US)

(72) Inventor: Travis Garthaffner, Midlothian, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 17/685,795

(22) Filed: Mar. 3, 2022

(65) Prior Publication Data

US 2022/0185530 A1 Jun. 16, 2022

Related U.S. Application Data

(62) Division of application No. 17/034,249, filed on Sep. 28, 2020, now Pat. No. 11,267,606, which is a (Continued)

(51) Int. Cl.
*B65D 5/16* (2006.01)
*B65D 5/42* (2006.01)
*B65D 5/72* (2006.01)

(52) U.S. Cl.
CPC ..... *B65D 5/16* (2013.01); *B65D 5/4204* (2013.01); *B65D 5/725* (2013.01)

(58) Field of Classification Search
CPC ..... B31B 50/52; B31B 50/0042; B31B 50/25; B31B 50/82; B65D 5/542; B65D 5/5004; B65D 5/725; B65D 5/4204; B65D 5/16
(Continued)

(56) References Cited

U.S. PATENT DOCUMENTS 271,177 A 1/1883 White
902,347 A * 10/1908 Tillinghast ..... B65D 71/36 229/122.1
(Continued)

FOREIGN PATENT DOCUMENTS

WO WO-2016/179345 A1 11/2016
WO WO-2017/023685 A1 2/2017
(Continued)

OTHER PUBLICATIONS

Grizzly long cut package containing canisters (single photograph), sold in stores during summer of 2018.
(Continued)

*Primary Examiner* — Christopher R Demeree
(74) *Attorney, Agent, or Firm* — Harness, Dickey & Pierce, P.L.C.

(57) ABSTRACT

The method includes a blank with sidewall panels, a first foot panel connected to a first one of the sidewall panels, a platform panel connected to the first foot panel, and a second foot panel connected to the platform panel, the method including first folding the sidewall panels and connecting respective side edges of the sidewall panels to form sidewalls of a package, second folding the platform panel to fit within a first end of the sidewalls so that the first foot panel and the second foot panel each at least partially press against a respective one of the sidewalls, and connecting the second foot panel to one of the sidewalls to stabilize the platform panel within the first end.

19 Claims, 13 Drawing Sheets

Related U.S. Application Data division of application No. 16/415,372, filed on May 17, 2019, now Pat. No. 10,787,288.

(58) Field of Classification Search

USPC ..... 229/122, 242, 122.1, 221, 240, 122.2, 229/122.32; 206/738, 526, 499; D9/416, D9/733; 221/305, 302, 309, 155, 194, 221/303

See application file for complete search history.

(56) References Cited

U.S. PATENT DOCUMENTS 1,764,468 A 6/1930 Pratt
2,072,695 A 3/1937 Wellman
D120,649 S 5/1940 Novak
2,299,027 A 10/1942 Novak
D162,809 S 4/1951 Gay
2,729,326 A 1/1956 Stadnyk
2,771,988 A 11/1956 Sweeney
2,875,938 A 3/1959 Bramhill
2,886,232 A 5/1959 Leone
2,926,813 A 3/1960 Marion
2,927,686 A 3/1960 Blum
3,164,298 A 1/1965 Repko
3,204,762 A 9/1965 Shanok et al.
3,263,861 A 8/1966 Carr
3,265,283 A 8/1966 Farguhar
3,278,080 A 10/1966 Luco
3,306,437 A 2/1967 Nelson
3,356,279 A 12/1967 Root
3,450,308 A 6/1969 Schoenefeld
D224,692 S 8/1972 Gray
D249,764 S 10/1978 Burklacich
4,170,325 A * 10/1979 Pawlowski ..... B65D 5/725 221/311
4,170,914 A 10/1979 Carrier
4,306,666 A 12/1981 Trammell, Sr.
4,405,044 A 9/1983 Flower et al.
4,566,607 A 1/1986 Smith
4,583,642 A 4/1986 Blythe et al.
4,739,922 A 4/1988 Zimmermann
4,752,029 A 6/1988 Buford
4,805,765 A * 2/1989 Barrett ..... B65D 5/724 229/122
4,899,929 A * 2/1990 Grollman ..... B65D 5/36 221/302
D308,146 S 5/1990 Speaker
D309,262 S 7/1990 Coiner
D321,134 S 10/1991 Toinet
D321,647 S 11/1991 Oldorf
D333,781 S 3/1993 Kobel
5,249,737 A 10/1993 Fritz et al.
5,370,220 A 12/1994 Wang
5,425,474 A 6/1995 Dalea et al.
5,443,204 A 8/1995 O'Donnell et al.
5,458,272 A 10/1995 Ward-Weber
D381,850 S 8/1997 Alig et al.
D400,095 S 10/1998 Uebele
5,836,478 A 11/1998 Weiss
D403,576 S 1/1999 Weiss
6,050,402 A 4/2000 Walter
D425,415 S 5/2000 Kumakura
6,062,424 A 5/2000 Simile-Gravina et al.
D429,462 S 8/2000 Kumakura et al.
D430,437 S 9/2000 Shimbo et al.
D431,931 S 10/2000 Sicignano, III
6,176,419 B1 1/2001 Holley, Jr.
6,216,944 B1 4/2001 Maglione
6,237,757 B1 5/2001 Alpern et al.
6,598,737 B2 7/2003 Rudnick
D482,914 S 12/2003 Prasad
6,851,553 B2 2/2005 Venable et al.
D502,621 S 3/2005 Ho
6,874,678 B2 4/2005 Prokosch et al.
6,902,062 B1 6/2005 Kumakura et al.
6,929,172 B2 8/2005 Bates et al.
D509,689 S 9/2005 Ho
7,073,665 B2 7/2006 Auclair et al.
D528,434 S 9/2006 Wolpow
7,134,593 B2 11/2006 Harrelson
D533,464 S 12/2006 Wolpow
D537,734 S 3/2007 Wolpow
7,195,118 B2 3/2007 Sutherland
D543,400 S 5/2007 Ho
D545,098 S 6/2007 Wolfson
7,284,662 B2 10/2007 DeBusk et al.
7,328,798 B2 2/2008 Auclair et al.
7,331,509 B2 2/2008 Bates et al.
7,357,254 B2 4/2008 Auclair et al.
D570,210 S 6/2008 McGrath
D572,955 S 7/2008 Barcena Zafra
7,413,101 B2 8/2008 Smalley et al.
D576,824 S 9/2008 Eksrom
D586,234 S * 2/2009 Lamoury ..... D9/733
7,604,157 B2 10/2009 Zammit et al.
D604,602 S 11/2009 Kohno
7,648,048 B2 1/2010 Smith
7,658,317 B2 2/2010 Wilkins
7,703,665 B2 4/2010 McGowan
7,721,889 B2 5/2010 Sutherland
7,743,972 B2 6/2010 Fogle
7,762,451 B2 7/2010 Harrelson
D643,747 S 8/2011 Rye et al.
7,992,765 B2 8/2011 Brand
8,162,206 B2 4/2012 Harrelson
8,485,423 B2 * 7/2013 Thomas ..... B65D 71/36 221/302
8,720,743 B2 5/2014 Smalley et al.
D706,129 S 6/2014 Boraczek et al.
9,096,344 B1 8/2015 Block
9,096,345 B2 * 8/2015 Bogdziewicz ..... B65D 5/0227
9,120,612 B2 9/2015 Fath et al.
9,309,034 B2 4/2016 Paredes et al.
D758,181 S 6/2016 Lutz et al.
D760,072 S 6/2016 Lutz
9,415,893 B2 * 8/2016 Wintermute ..... B65D 5/722
9,475,606 B2 10/2016 Ball et al.
D778,149 S 2/2017 Frick
D781,142 S 3/2017 Trujillo
D793,224 S 8/2017 Sagardoy Muniesa et al.
D794,443 S 8/2017 Frick
D804,302 S 12/2017 Larkin et al.
9,994,344 B2 6/2018 Buscema et al.
10,065,762 B2 9/2018 Schultz et al.
D830,789 S 10/2018 Brooks
D837,645 S 1/2019 Larkin et al.
10,173,820 B2 1/2019 Patwardhan
10,179,671 B2 1/2019 Umentum et al.
10,214,342 B2 2/2019 Parcevaux
D843,128 S 3/2019 Pena
D845,759 S 4/2019 Arzano
10,259,611 B2 4/2019 Grace et al.
10,435,217 B2 10/2019 Paredes et al.
10,479,549 B2 11/2019 Kearns
D870,551 S 12/2019 Klesmith
10,543,955 B1 1/2020 Turturro et al.
D877,530 S 3/2020 Sperry
D885,883 S 6/2020 Hagee et al.
10,669,062 B2 6/2020 Schultz et al.
10,759,555 B2 9/2020 Buscema et al.
10,787,288 B1 9/2020 Garthaffner
D947,021 S 3/2022 Garthaffner
D947,022 S 3/2022 Bellamah
2002/0074248 A1 6/2002 Venable
2004/0099558 A1 5/2004 Oliff et al.
2005/0274638 A1 12/2005 Smith
2006/0027639 A1 2/2006 Rasmussen
2006/0091192 A1 5/2006 Coltri-Johnson
2006/0283927 A1 * 12/2006 Walsh ..... B65D 5/0281 229/122.1
2007/0152028 A1 7/2007 McGowan
2010/0044421 A1 2/2010 Learn
2011/0036749 A1 2/2011 Jacobsson et al.

(56) References Cited

U.S. PATENT DOCUMENTS

| | | | |
|---|---|---|---|
| 2012/0018503 | A1 | 1/2012 | Walling et al. |
| 2012/0255968 | A1 | 10/2012 | Karay et al. |
| 2012/0325840 | A1 | 12/2012 | Restaino |
| 2012/0325841 | A1 | 12/2012 | Restaino |
| 2012/0325842 | A1 | 12/2012 | Restaino |
| 2014/0299656 | A1 | 10/2014 | Wintermute |
| 2014/0319205 | A1 | 10/2014 | Schultz |
| 2016/0185484 | A1 | 6/2016 | Bakx |
| 2017/0029162 | A1 | 2/2017 | Kearns |
| 2017/0203872 | A1 | 7/2017 | Grace et al. |
| 2018/0009598 | A1 | 1/2018 | Parcevaux |
| 2018/0044086 | A1 | 2/2018 | Patwardhan |
| 2018/0141734 | A1 | 5/2018 | Kooc et al. |
| 2018/0162575 | A1 | 6/2018 | Buscema et al. |
| 2018/0370680 | A1 | 12/2018 | Schultz et al. |
| 2019/0217988 | A1 | 7/2019 | Umentum et al. |
| 2020/0216246 | A1 | 7/2020 | Ball et al. |
| 2020/0317391 | A1 | 10/2020 | Schultz et al. |
| 2021/0039828 | A1 | 2/2021 | Song et al. |
| 2021/0092997 | A1 | 4/2021 | Lin |
| 2021/0100222 | A1 | 4/2021 | Hawkins et al. |

FOREIGN PATENT DOCUMENTS

| | | | |
|---|---|---|---|
| WO | WO-2020/017735 | A1 | 1/2020 |
| WO | WO-2020/212360 | A1 | 10/2020 |

OTHER PUBLICATIONS

Office Action dated Oct. 6, 2020, issued in co-pending U.S. Appl. No. 29/691,645.

Hannah Jackson, "Tea Hugger" retrieved Aug. 14, 2020 from URL: https://www.behance.net/gallery/846291/Tea-Hugger.

Brang Reynolds, "Why I Learned Sourcing Packaging for My Nutraceutical Brand" published on Mar. 7, 2018, retrieved Aug. 14, 2020 from URL: https://medium.com/in-formation-holdings/what-i-learned-sourcing-packaging-million-dollar-idea-project-8feeea09e87b.

Notice of Allowance dated Mar. 29, 2021, issued in co-pending U.S. Appl. No. 29/691,645.

Notice of Allowance dated Jul. 13, 2021, issued in co-pending U.S. Appl. No. 29/691,645.

Notice of Allowance dated Nov. 26, 2021, issued in co-pending U.S. Appl. No. 29/691,645.

Office Action dated Jan. 13, 2023, issued in corresponding U.S. Appl. No. 29/830,124.

Dispenser Packaging Boxes, posting date unavailable [online], [retrieved Jan. 8, 2023], Retrieved from internet, https://www.packagingboxespro.com/product/dispenser-boxes (Year: 2023).

Custom CBD Gravity Dispenser Boxes, posting date unavailable [online], [retrieved Jan. 8, 2023], Retrieved from internet, https://www.customboxline.com/product/custom-cbd-gravity-dispenser-boxes (Year: 2023).

Vitamin B12, posting date unavailable [online], [retrieved Jan. 8, 2023], Retrieved from internet, https://takecareof.com/products/vitamin-b-12_3 (Year: 2023).

* cited by examiner

METHOD OF USING BLANK WITH FOOT PANEL

CROSS-REFERENCE TO RELATED APPLICATIONS

This application is a divisional of U.S. application Ser. No. 17/034,249, filed Sep. 28, 2020, which is a divisional of U.S. application Ser. No. 16/415,372, filed May 17, 2019, the entire contents of each of which are incorporated herein by reference.

BACKGROUND

Field

Example embodiments relate generally to blanks and packages for consumer items.

Related Art

Cartons are often used to store and ship consumable items. Generally, once the carton is received by a store, the contents of the carton are removed to sell the consumable items.

SUMMARY

At least one example embodiment is directed toward a blank.

In an example embodiment, the blank includes a plurality of sidewall panels; a first foot panel connected via a first fold line to a first panel of the plurality of sidewall panels; a platform panel connected via a second fold line to the first foot panel; a second foot panel connected via a third fold line to the platform panel; a tab at least partially defined by one or more cut lines in a second panel of the plurality of sidewall panels, the tab configured to retain a bottom edge of the second foot panel, upon assembly of the blank into a package; and a tear-off section defined by one or more of the plurality of sidewall panels.

In an example embodiment, the plurality of sidewall panels further includes, a first side panel connected via a fourth fold line to a first side of the first panel of the plurality of sidewall panels, and a second side panel connected via a fifth fold line to a second side of the first panel of the plurality of sidewall panels, wherein the second panel of the plurality of sidewall panels is connected via a sixth fold line to the first side panel.

In an example embodiment, the second panel of the plurality of sidewall panels defines a window.

In an example embodiment, the window has an elongate shape.

In an example embodiment, the tab is further defined by a horizontal fold line.

In an example embodiment, the blank further includes a third foot panel connected via a seventh fold line to the platform panel; and a fourth foot panel connected via an eighth fold line to the platform panel, the third foot panel and the fourth foot panel being on opposite sides of the platform panel.

In an example embodiment, the first foot panel and the second foot panel are on opposite sides of the platform panel.

In an example embodiment, the first foot panel is configured to be adjacent to a lower surface of the first panel of the plurality of sidewall panels, upon assembly of the blank into the package.

In an example embodiment, the first foot panel is configured to be adjacent to a lower surface of the first panel of the plurality of sidewall panels, the third foot panel is configured to be adjacent to a lower surface of a first side panel of the plurality of sidewall panels, and the fourth foot panel is configured to be adjacent to a lower surface of a second side panel of the plurality of sidewall panels, upon assembly of the blank into the package.

In an example embodiment, the blank further includes a glue panel connected via a ninth fold line to the second panel of the plurality of sidewall panels, the glue panel configured to be adhered to the second side panel of the plurality of sidewall panels upon assembly of the blank into the package.

In an example embodiment, the blank further includes a glue panel connected via a ninth fold line to the second side panel of the plurality of sidewall panels, the glue panel configured to be adhered to the second panel of the plurality of sidewall panels upon assembly of the blank into the package.

In an example embodiment, the tear-off section is at least partially defined by the first panel of the plurality of sidewall panels.

In an example embodiment, the tear-off section defines at least one finger hole.

In an example embodiment, the tear-off section is defined by the first panel, the first side panel, and the second side panel of the plurality of sidewall panels.

In an example embodiment, the tear-off section, and the first side panel of the plurality of sidewall panels, define a first finger hole.

In an example embodiment, the tear-off section, and the second side panel of the plurality of sidewall panels, define a second finger hole.

In an example embodiment, a width of the second foot panel is less than a width of the first foot panel.

In an example embodiment, a distance between a first end and a second end of the third foot panel is less than a distance between the second fold line and the third fold line, and a distance between a first end and a second end of the fourth foot panel is less than the distance between the second fold line and the third fold line.

In an example embodiment, a width of the second foot panel is less than a width of the first foot panel, a distance between a first end and a second end of the third foot panel is less than a distance between the second fold line and the third fold line, and a distance between a first end and a second end of the fourth foot panel is less than the distance between the second fold line and the third fold line.

In an example embodiment, the blank further includes a top panel connected via a tenth fold line to the second panel of the plurality of sidewall panels, and a tuck panel connected via a eleventh fold line to the top panel.

In an example embodiment, the blank further includes a top panel connected via a tenth fold line to the second panel of the plurality of sidewall panels, a tuck panel connected via an eleventh fold line to the top panel, a first dust panel connected via a twelfth fold line to the first side panel of the plurality of sidewall panels, and a second dust panel connected via a thirteenth fold line to the second side panel of the plurality of sidewall panels.

In an example embodiment, the blank further includes an arcuate-shaped cut-out at a top edge of the first panel of the plurality of sidewall panels.

At least another example embodiment relates to a package.

In an example embodiment, the package includes a plurality of sidewall panels; a first foot panel connected via a first fold line to a first panel of the plurality of sidewall panels; a platform panel connected via a second fold line to the first foot panel; a second foot panel connected via a third fold line to the platform panel; a tab at least partially defined by one or more cut lines in a second panel of the plurality of sidewall panels, wherein the tab is configured to retain a bottom edge of the second foot panel; and a tear-off section defined by one or more of the plurality of sidewall panels.

In an example embodiment, the plurality of sidewall panels further includes, a first side panel connected via a fourth fold line to a first side of the first panel of the plurality of sidewall panels, and a second side panel connected via a fifth fold line to a second side of the first panel of the plurality of sidewall panels, wherein the second panel of the plurality of sidewall panels is connected via a sixth fold line to the first side panel.

In an example embodiment, the second panel of the plurality of sidewall panels defines a window.

In an example embodiment, the window has an elongate shape.

In an example embodiment, the tab is further defined by a horizontal fold line.

In an example embodiment, the package further includes a third foot panel connected via a sixth fold line to the platform panel; and a fourth foot panel connected via a seventh fold line to the platform panel, the third foot panel and the fourth foot panel being on opposite sides of the platform panel.

In an example embodiment, the first foot panel and the second foot panel are on opposite sides of the platform panel.

In an example embodiment, the first foot panel is adjacent to a lower surface of the first panel of the plurality of sidewall panels.

In an example embodiment, the first foot panel is adjacent to a lower surface of the first panel of the plurality of sidewall panels, the third foot panel is adjacent to a lower surface of a first side panel of the plurality of sidewall panels, and the fourth foot panel is adjacent to a lower surface of a second side panel of the plurality of sidewall panels.

In an example embodiment, the package further includes a glue panel connected via a eighth fold line to the second panel of the plurality of sidewall panels, the glue panel adhered to the second side panel of the plurality of sidewall panels.

In an example embodiment, the package further includes a glue panel connected via a eighth fold line to the second side panel of the plurality of sidewall panels, the glue panel adhered to the second panel of the plurality of sidewall panels.

In an example embodiment, the tear-off section is at least partially defined by the first panel of the plurality of sidewall panels.

In an example embodiment, the tear-off section defines at least one finger hole.

In an example embodiment, the tear-off section is defined by the first panel, the first side panel, and the second side panel of the plurality of sidewall panels.

In an example embodiment, the tear-off section and the first side panel of the plurality of sidewall panels define a first finger hole.

In an example embodiment, the tear-off section and the second side panel of the plurality of sidewall panels define a second finger hole.

In an example embodiment, a width of the second foot panel is less than a width of the first foot panel.

In an example embodiment, a distance between a first end and a second end of the third foot panel is less than a distance between the second fold line and the third fold line, and a distance between a first end and a second end of the fourth foot panel is less than the distance between the second fold line and the third fold line.

In an example embodiment, a width of the second foot panel is less than a width of the first foot panel, a distance between a first end and a second end of the third foot panel is less than a distance between the second fold line and the third fold line, and a distance between a first end and a second end of the fourth foot panel is less than the distance between the second fold line and the third fold line.

In an example embodiment, the package further includes a top panel connected via a ninth fold line to the second panel of the plurality of sidewall panels, and a tuck panel connected via a tenth fold line to the top panel.

In an example embodiment, the package further includes a top panel connected via a ninth fold line to the second panel of the plurality of sidewall panels, a tuck panel connected via an tenth fold line to the top panel, a first dust panel connected via a eleventh fold line to the first side panel of the plurality of sidewall panels, and a second dust panel connected via a twelfth fold line to the second side panel of the plurality of sidewall panels.

In an example embodiment, the package is configured to be converted from a carton to a dispenser by removing the tear-off section.

In an example embodiment, the package includes consumer goods.

In an example embodiment, the consumer goods are one or more cans of a smokeless tobacco product.

DETAILED DESCRIPTION

Figure 1:
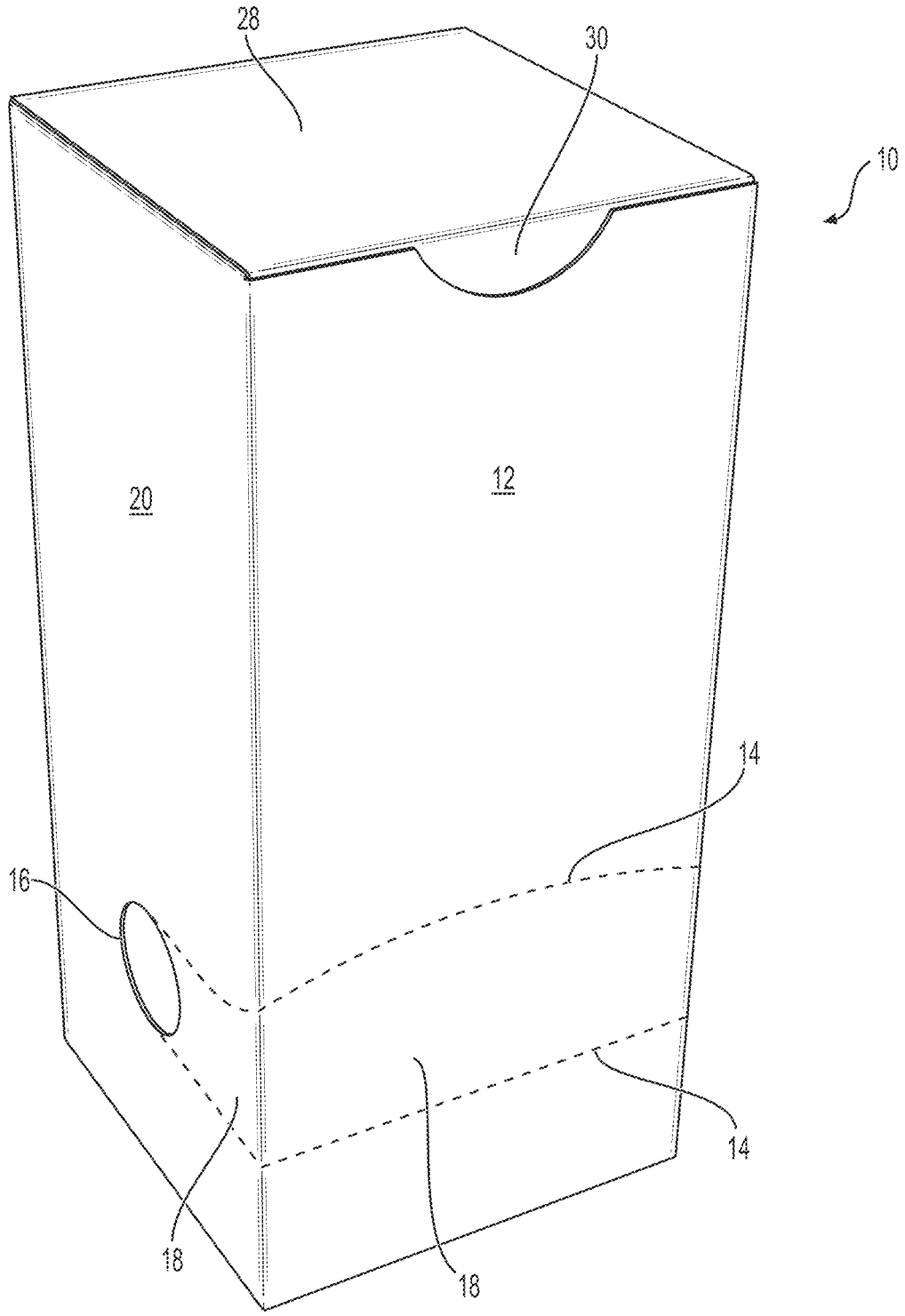
FIG. 1 is an illustration of a front perspective view of a package, in accordance with an example embodiment.

Some detailed example embodiments are disclosed herein. However, specific structural and functional details disclosed herein are merely for purposes of describing example embodiments. Other embodiments may, however, be embodied in many alternate forms and should not be construed as limited to only the example embodiments set forth herein.

Accordingly, while embodiments are capable of various modifications and alternative forms, example embodiments thereof are shown by way of example in the drawings and will herein be described in detail. It should be understood, however, that there is no intent to limit embodiments to the particular forms disclosed, but to the contrary, embodiments are to cover all modifications, equivalents, and alternatives thereof.

It should be understood that when an element is referred to as being "on," "connected to," "coupled to," "attached to," "adjacent to," or "covering", etc., another element or layer, it may be directly on, connected to, coupled to, attached to, adjacent to or covering, etc., the other element or layer, or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, or if these terms are able to be equated to a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

In the drawings, the thicknesses of layers and regions may be exaggerated or under-exaggerated for clarity. In this document, a fold line includes a fold, a score line, a crease line, an embossed line, a molded line, a stamped line, a printed line, a pressed line, or any other type of line that is considered a fold line in the art, or any combination thereof. A fold line is formed from folding, carving, molding, stamping, printing, embossing, pressing, or combinations thereof.

FIG. 1 is an illustration of a front perspective view of a package 10, in accordance with an example embodiment.

In an example embodiment, the package includes a tear-off section 18. In an example embodiment, the tear-off section 18 is at least partially defined by a lower end of the package 10. In an example embodiment, the tear-off section 18 is at least partially defined by a front panel 12 of the package 10. In an example embodiment, a tear line 14 circumscribes or partially circumscribes the tear-off section 18, allowing the tear-off section 18 to be torn off to convert the package 10 from a carton (e.g., for storing and/or shipping consumer items 200) to a gravity-fed dispenser (e.g., for dispensing consumer items). In an example embodiment, the tear-off section 18 is at least partially defined by a first side panel 20 and a second side panel 22 (see the second side panel 22 in FIG. 2). In an example embodiment, the tear-off section 18 is defined by the front panel 12, the first side panel 20, and the second side panel 22.

In an example embodiment, the tear line 14 is a line formed by a line of slits or perforations that act to weaken the package 10 material to allow the tear-off section 18 to be removed from the remainder of the package 10. In an example embodiment, the tear line 14 can include a significantly scored line that acts to weaken the package 10 material to make the material easy to tear, a line of perforations, or any other type of line that is considered a tear line in the art, or any combination thereof. In an example embodiment, tear line 14 can include tear line portions **14*a*-14*h* shown, for example, in FIG. 5**.

In an example embodiment, a package 10 includes a side finger hole 16 that facilitates the tearing off of the tear-off section 18. In an example embodiment, the tear-off section 18 defines a center finger hole (not shown), where the center finger hole is defined for instance by at least one first portion **18*a* (see FIG. 5) of the tear-off section 18. In an example embodiment, the finger hole 16 is defined by the tear-off section 18 and the first side panel 20. In an example embodiment, a package 10 includes a side finger hole 17 that facilitates the tearing off of the tear-off section 18 (see FIG. 2). In an example embodiment, the finger hole 17 is defined by the tear-off section 18 and the second side panel 20**. Some example embodiments may not include any finger holes.

In an example embodiment, a top panel 28 is included on a top end of the package 10. In an example embodiment, as described in further detail herein, the top panel 28 allows the top end of the package 10 to be opened and closed (e.g., the at least one top panel 28 is re-closeable). In an example embodiment, the top panel 28 includes a tuck panel 30 (seen in better detail in FIG. 5) along a top edge of the top panel 28, where the tuck panel 30 can, for example, allow the top end of the package 10 to be opened and closed.

Figure 2:
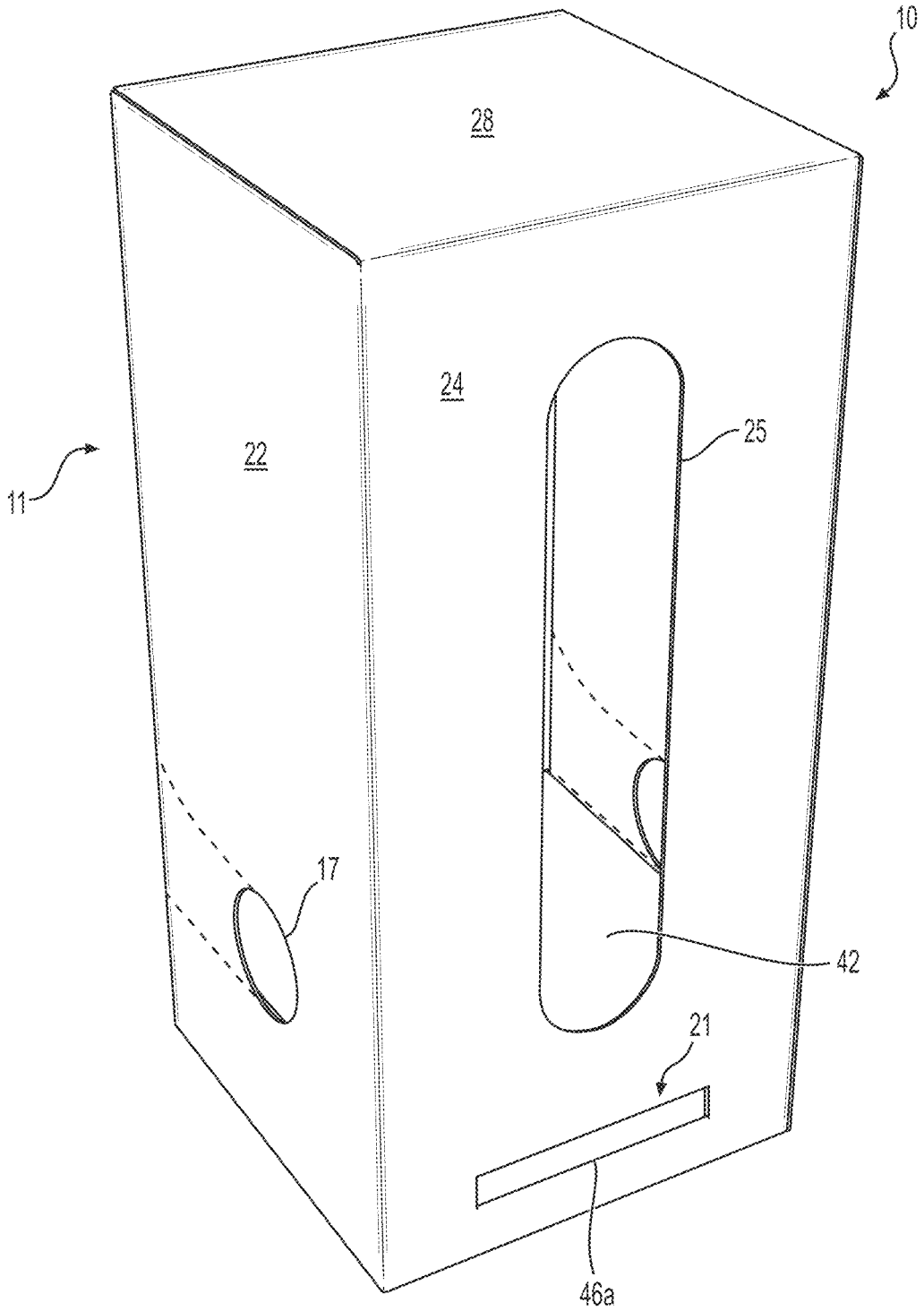
FIG. 2 is an illustration of a rear perspective view of a package, in accordance with an example embodiment.

FIG. 2 is an illustration of a rear perspective view of a package 10, in accordance with an example embodiment. In an example embodiment, a back panel 24 of the package 10 defines a window 25 for visually seeing the interior of package 10, including for example, consumer items if consumer items are located in the package. In an example embodiment, the back panel 24 of the package 10 defines a tab 21 that holds and retains a bottom edge 46*a* of a second foot panel 46, as described in more detail with respect to FIGS. 7 and 8. In an example embodiment, the package 10 includes sidewalls 11, where sidewalls 11 include the front panel 12, the first side panel 20, the second side panel 22 and the back panel 24.

Figure 3:
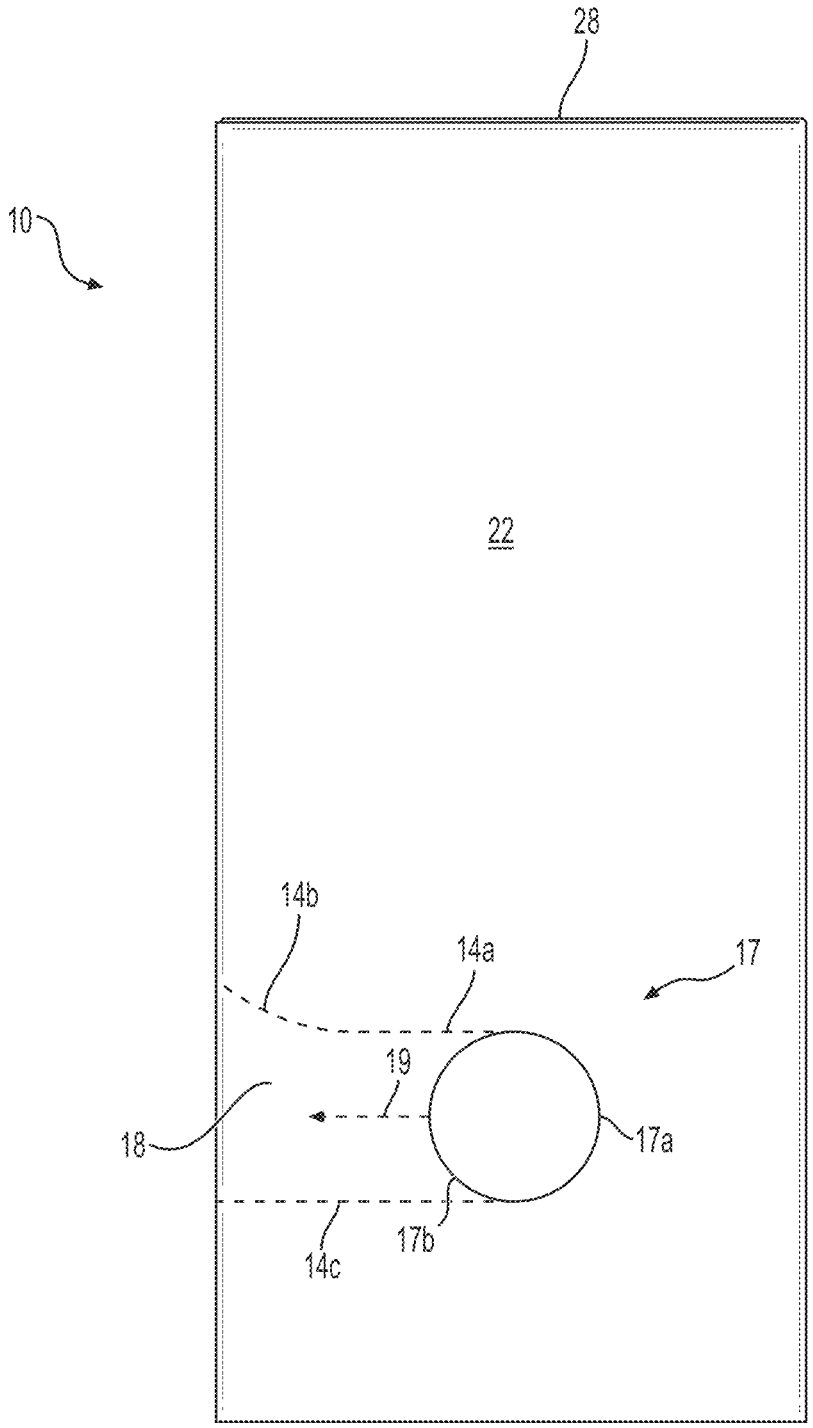
FIG. 3 is an illustration of a side view of a package, in accordance with an example embodiment.

FIG. 3 is an illustration of a side view of a package 10, in accordance with an example embodiment. In an example embodiment, a first portion 17*a* of side finger hole 17 is formed by second side panel 22. In an example embodiment, the side finger hole 17 is at least partially defined by an edge 17*b* that is part of the tear-off section 18. In an example embodiment, the edge 17*b* is on a side of the side finger hole 16 that faces a tear-off direction 19. This edge 17*b* facilitates a tearing off of the tear-off section 18. In an example embodiment, the tear-off direction 19 is an imaginary line that starts at a center of the edge 16*b*, and is about perpendicular to the edge 16*b*, and runs about equidistant between a first upper/side tear line 14*a* and a first lower/side tear line 14*c* (where the first upper/side tear line 14*a* and the first lower/side tear line 14*c* form part of the tear line 14, as shown in better detail in FIG. 5). The tear-off direction 19 emulates a direction that the edge 16*b* would most-easily travel, if the tear-off section 18 were to be torn off by pulling on the edge 16*b*.

In an example embodiment, the second side panel 22 defines a first upper/side portion 14*a* of the tear line and a second upper/side portion 14*b* of the tear line, where the second upper/side portion 14*b* may be crescent or arcuate shaped to enlarge an overall size of the tear-off section 18. In an example embodiment, the shape of the finger hole 17 is square, rectangular, circular, oval, or other shapes (any of the other finger holes, if more than one finger hole is used, can have the same or different shapes).

Figure 4:
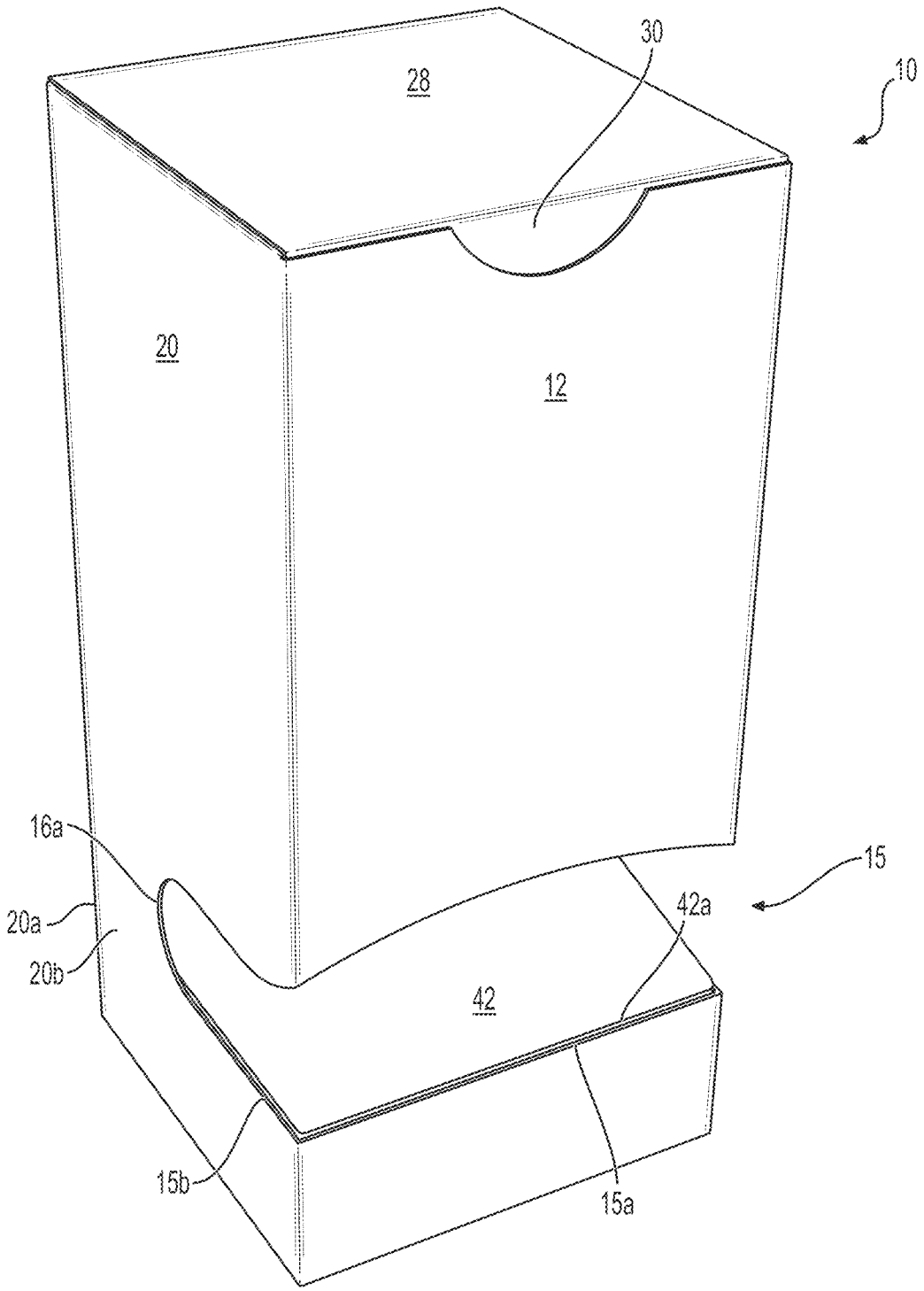
FIG. 4 is an illustration of a front perspective view of a package, with a tear-off section torn off, in accordance with an example embodiment.

FIG. 4 is an illustration of a front perspective view of a package 10, with tear-off section 18 removed, in accordance with an example embodiment. In an example embodiment, removed tear-off section 18 exposes a platform panel 42. In an example embodiment, the platform panel 42 is able to support consumer items for dispensing. In an example embodiment, the package 10 of FIG. 4 is used as a gravity-fed dispenser, where an initial stack of consumer items in the package 10 are removed one at a time from an opening 15 created by the removal of the tear-off section 18.

In an example embodiment, the platform panel 42 is substantially flat. In an example embodiment, the platform panel 42 is substantially flat along a width-wise span across a first end 42*a*, and the first end 42*a* is about flush with, higher than, or lower than a straight, front/lower edge 15*a* of the opening 15. In an example embodiment, a width-wise span of a second end 42*b* of the platform panel 42 is substantially flat, as shown for instance in FIG. 10. In an example embodiment, the platform panel 42 is substantially flat, along a depth-wise span, from the first end 42*a* to the second end 42*b*.

In an example embodiment, a lower side edge 15*b* of the opening 15 is about level with an elevation of the platform panel 42. This can, for example, allow a consumer item to be viewed from a side view of the package 10, and/or allow a consumer item to be removed from the package 10, by holding the consumer item from the sides and pulling it out of the front of the package 10. In an example embodiment, a distance exists between a first portion 16*a* of side finger hole 16 and a first edge 20*a* of the first side panel 20. This can, for example, allow a portion 20*b* of the first side panel 20 to be positioned on sides of the opening 15 to maintain a consumer item on the platform panel 42.

Figure 5:
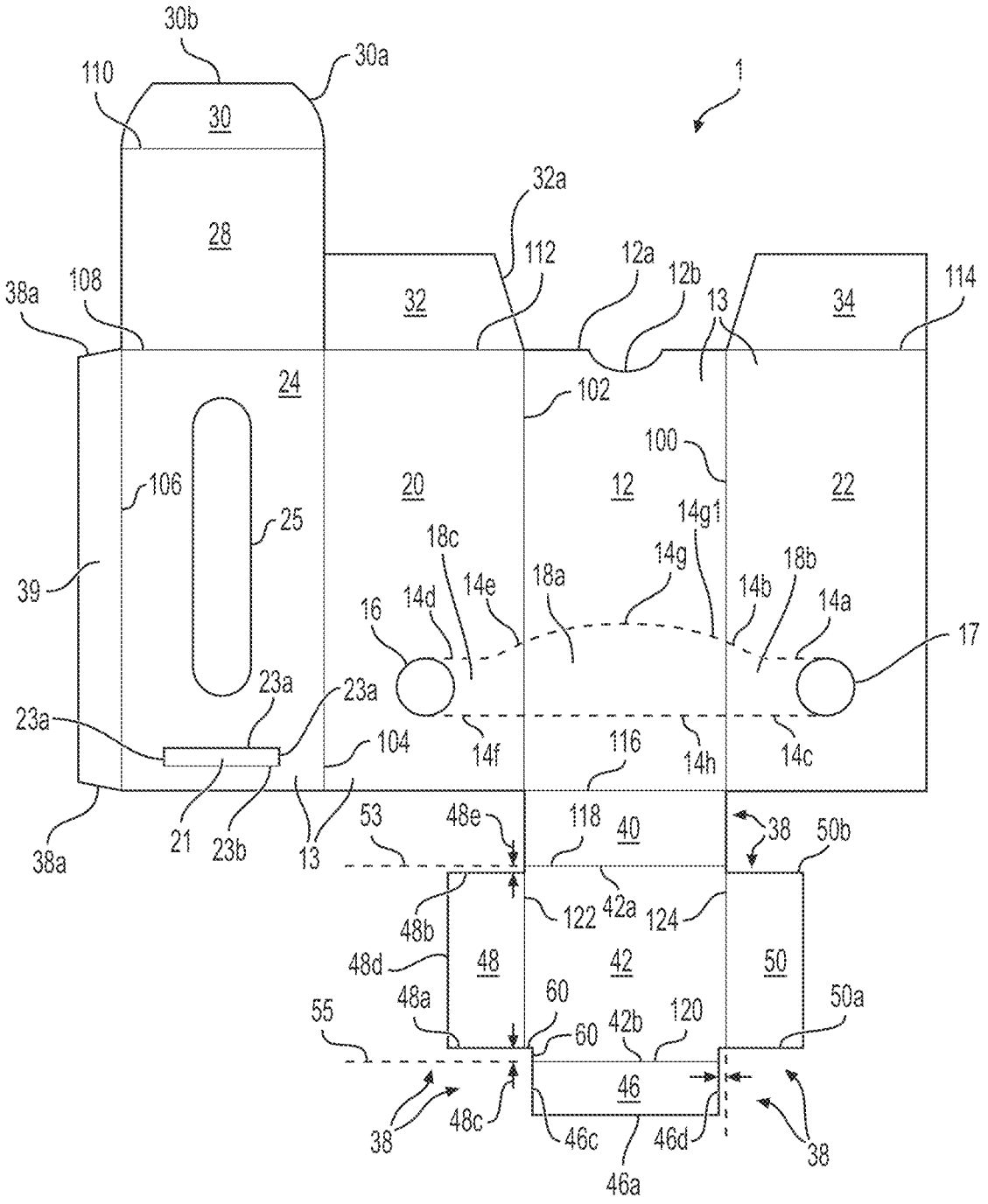
FIG. 5 is an illustration of a blank, in accordance with an example embodiment.

FIG. 5 is an illustration of a blank, in accordance with an example embodiment. In an example embodiment, the blank 1 can be folded and formed into a package 10, as described herein.

In an example embodiment, the blank 1 includes sidewall panels 13 that are erected to form the sidewalls 11 of the package 10. In an example embodiment, the sidewall panels 13 include a front panel 12, a first side panel 20 on a side of the front panel 12, and a second side panel 22 on an opposite side of the front panel 12, where a sixth fold line 102 and a seventh fold line 100 respectively divide the front panel 12 from the first side panel 20 and the sixth side panel 22. In an example embodiment, the sidewall panels 13 further include the back panel 24. In an example embodiment, the back panel 24 is on a side of the first side panel 20, where an eighth fold line 104 divides the first side panel 20 from the back panel 24 (as shown). In an example embodiment, the back panel 24 could be on a side of the second side panel 22, where a fold line would divide the second side panel 22 from the back panel 24. In an example embodiment, the back panel 24 could include, for example, panels configured to overlap, one connected to a side of first side panel 20, and one connected to a side of second side panel 22. Other variations may be used.

In an example embodiment, the back panel 24 defines a window 25. In an example embodiment, the first window runs along a longitudinal length of the back panel 24. In other example embodiments, a window 25 may be located in other panels in addition to or instead of a window in back panel 24. In an example embodiment, the window 25 may be shaped as a rectangle, a rectangle with rounded corners (as shown), an oval, a circle, a square, a square with rounded corners, a slit, or any other type of shape.

In an example embodiment, the blank 1 includes a first foot panel 40 connected to a lower end of the front panel 12, wherein a first fold line 116 divides the first foot panel 40 from the front panel 12. In other example embodiments, foot panel 40 may be connected to a lower end of one of the side panels 20, 22, or to a lower end of the back panel 24.

In an example embodiment, blank 1 includes a platform panel 42 connected to first foot panel 40, wherein a second fold line 118 divides the platform panel 42 from the first foot panel 40. In an example embodiment, the first foot panel 40 has a length (distance between the first fold line 116 and the second fold line 118) that is about equal to a length between the first fold line 116 and a lower tear line portion 14*h* (of tear line 14) that is defined by the front panel 12. In other example embodiments, the first foot panel 40 has a length (distance between the first fold line 116 and the second fold line 118) that is greater than a length between the first fold line 116 and the lower tear line portion 14*h*, while yet in other example embodiments, the first foot panel 40 has a length (distance between the first fold line 116 and the second fold line 118) that is smaller than a length between the first fold line 116 and the lower tear line portion 14*h*. In an example embodiment, the platform panel 42 has a width that is about the same as the width of the front panel 12. In an example embodiment, the platform panel 42 has a width that is smaller than the width of the front panel 12.

In an example embodiment, a blank 1 includes one or more additional foot panels 38, wherein the first foot panel 40, as well as the one or more additional foot panels 38, support the platform panel 42 when the blank 1 is folded into a package 10. In an example embodiment, the one or more additional foot panels 38 extend from one or more edges of platform panel 42.

In an example embodiment, the one or more additional foot panels 38 include a second foot panel 46 extending from the second end 42*b* of the platform panel 42, wherein a third fold line 120 divides the second foot panel 46 from the platform panel 42. In an example embodiment, the one or more additional foot panels 38 include a third foot panel 48 and a fourth foot panel 50 extending from sides of the platform panel 42, wherein a fourth fold line 122 divides the third foot panel 48 from the platform panel 42, and a fifth fold line 124 divides the fourth foot panel 50 from the platform panel 42.

In an example embodiment, platform panel 42 has a greater width (the distance between the fourth fold line 122 and the fifth fold line 124) than the width of second foot panel 46 (the distance between an end 46*c* and an end 46*d* of second foot panel 46). In an example embodiment, platform panel 42 has a greater length (the distance from the first end 42*a* to the second end 42*b* of platform panel 42) than the length of third foot panel 48 (the distance between a first end 48*a* and a second end 48*b* of the third foot panel 48). In an example embodiment, platform panel 42 has a greater length (the distance from the first end 42*a* to the second end 42*b* of platform panel 42) than the length of fourth foot panel 50 (the distance between a first end 50*a* and a second end 50*b* of the fourth foot panel 48).

In an example embodiment, the third foot panel 48 is shorter than the length of the platform panel 42 (the distance between the first end 42*a* and the second end 42*b*), by a distance that equals a first gap 48*c* (between end 48*a* and an imaginary line 55 that runs through, and is collinear with, the second end 42*b*) and a second gap 48*e* (between end 48*b* and an imaginary line 53 that runs through, and is collinear with, the first end 42*a*). In an example embodiment, the fourth foot panel 50 has a same length (from a first end 50*a* to a second end 50*b*) as the at least one third foot panel 48, and is shorter than the length of the platform panel 42 by the same gaps 48*c* and 48*e*. In an example embodiment, the second foot panel 46 has a width (from a first end 46*c* to a second end 46*d*) that is shorter than a width of the platform panel 42 (from the fourth fold line 122 to the fifth fold line 124).

Figure 7:
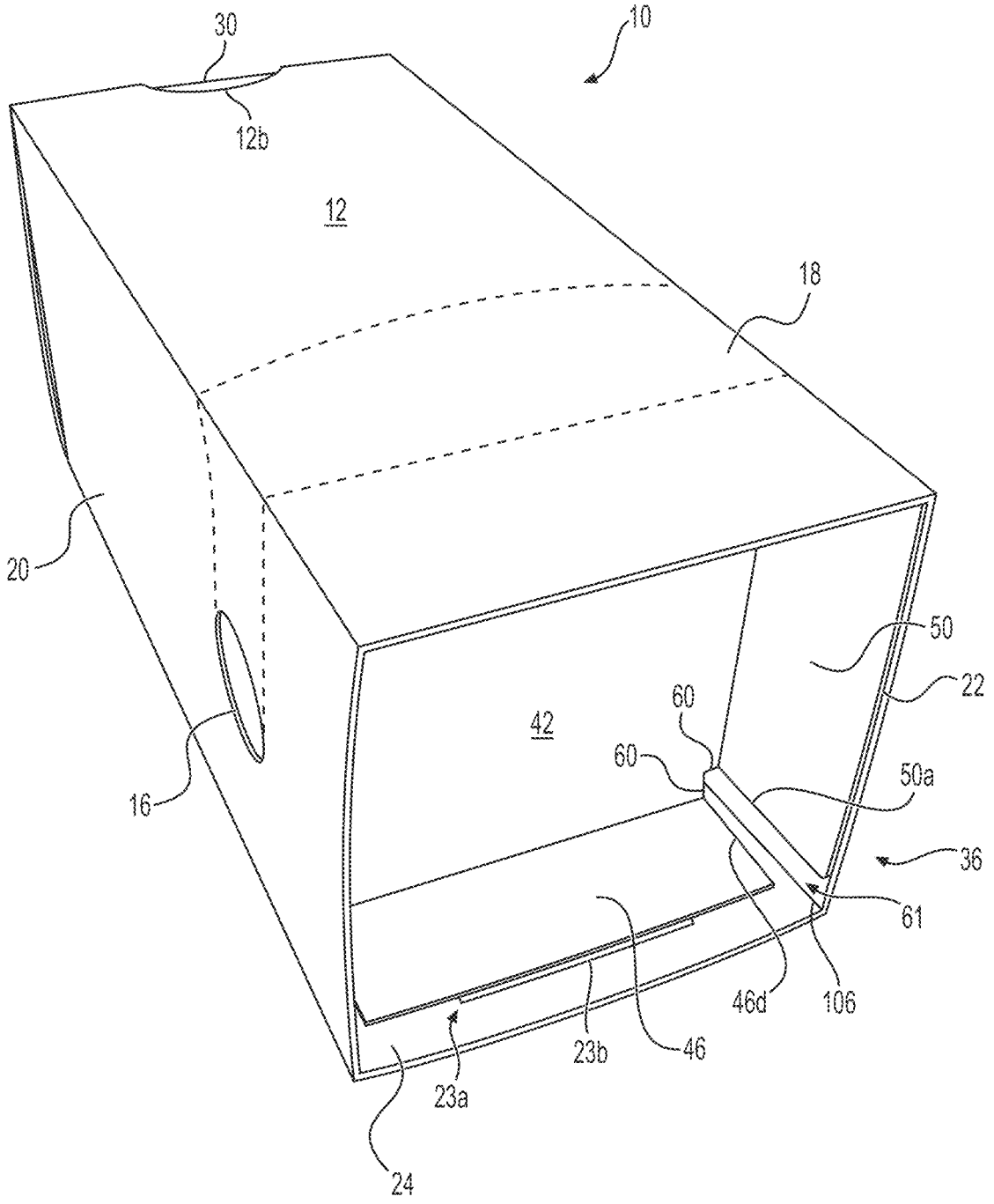
FIG. 7 is an illustration of a bottom/front perspective view of a package in a partially assembled configuration, in accordance with an example embodiment.

In an example embodiment, by making the width of second foot panel 46 smaller than the distance between the fourth fold line 122 and the fifth fold line 124, and the length of panels 48 and 50 smaller than the distance from the first end 42*a* to the second end 42*b* of platform 42, a cut-out 60 is formed in at least some corners of the platform panel 42 (see, for example, FIGS. 5, 7-8 and 10, showing cut-out 60 in two of the corners of platform panel 42), where the cut-out 60 can allow for an easier assembly of the package 10 (see in particular FIG. 7). In some example embodiments, the width of panel 46 can be the same as the width of platform 42, and the length of panels 48 and 50 can be the same as the length of platform 42.

In an example embodiment, back panel 24 includes a tab 21 defined by a cut line (or cut lines) 23*a* and a ninth fold line 23*b*, wherein tab 21 is configured to retain second foot panel 46 when blank 1 is folded into a package 10. In another example embodiment, a tab 21 could be included in front panel 12, if for example, first foot panel 40 was connected to the back panel 24 instead of being connected to front panel 12 as shown. In another example embodiment, a tab 21 could be included in one of the side panels 20/22 to retain a different foot panel. In another example embodiment, tabs 21 could be included in multiple panels (e.g., panel 24, 20, 12 and/or 22) to retain multiple foot panels. Other suitable alternatives may be used, including embodiments without a tab 21. In an example embodiment, a distance between the ninth fold line 23*b* and the lower tear line portion 14*f* (or tear line 14), is about equal to a length of the second foot panel 46 (the length being a distance from the third fold line 120 to a bottom edge 46*a* of the second foot panel 46).

In an example embodiment, a first glue panel 39 is connected to a side edge of the back panel 24, where a tenth fold line 106 divides the back panel 24 from the first glue panel 39. In an example embodiment, the first glue panel 39 has tapered ends 38*a*.

In an example embodiment, the tear-off section 18 is defined by front panel 12, first side panel 20 and second side panel 22. In an example embodiment, the front panel 12 defines a first portion 18*a* of the tear-off section 18, where an upper tear line portion 14*g* and a lower tear line portion 14*h* define the first portion 18*a*. In an example embodiment, the first portion 18*a* is a center portion of the tear-off section 18. In an example embodiment, the lower tear line portion 14*h* is defined to be substantially straight. In an example embodiment, the upper tear line portion 14*g* is arcuate shaped, so that once the blank is folded to form a package, and once the tear-off section 18 is removed, opening 15 is larger at the front panel than in the side panels 20/22. In an example embodiment, the second side panel 22 defines a second portion 18*b* of the tear-off section 18. In an example embodiment, the first upper/side tear line portion 14*a*, the second upper/side tear line portion 14*b* and a first lower/side tear line portion 14*c* at least partially define the second portion 18*b* of the tear-off section 18. In an example embodiment, the first upper/side tear line portion 14*a* and the first lower/side tear line portion 14*c* are substantially straight, whereas the second upper/side tear line portion 14*b* is curved or arcuate shaped, and continues as upper tear line portion 14*g* in front panel 12. In an example embodiment, the first side panel 20 defines a third portion 18*c* of the tear-off section 18. In an example embodiment, a third upper/side tear line portion 14*d*, a fourth upper/side tear line portion 14*e* and a second lower/side tear line portion 14*f* at least partially define the at least one third portion 18*c* of the tear-off section 18. In an example embodiment, the third upper/side tear line portion 14*d* and the second lower/side tear line portion 14*f* are substantially straight, whereas the fourth upper/side tear line portion 14*e* is curved or arcuate shaped, and continues as upper tear line portion 14*g* in front panel 12. Other sizes and shapes of the tear-off section 18, and the tear line portions, can be used in other embodiments. In an example embodiment, one or more portions of the tear-off section 18 define finger holes, or at least partially define finger holes.

In an example embodiment, the front panel 12 defines the tear-off section 18, or defines the first portion 18*a* of the tear-off section 18, in such a way that an ample portion of the front panel 12 remains available to display indicia information that includes marketing indicia, product information indicia, or combinations thereof. That is to say, in an embodiment, the tear-off section 18, or the at least one first portion 18*a* of the tear-off section 18, monopolizes only part of the front panel 12, leaving an ample remaining portion of the front panel 12 available for displaying the indicia information.

In an embodiment, the panel of the blank 1 that defines the first portion 18*a* of the tear-off section 18, or which defines the center portion of the tear-off section 18, has the first foot panel 40 extending from a lower edge thereof.

In an example embodiment, blank 1 includes a top panel 28 connected to a top edge of back panel 24, where an eleventh fold line 108 divides the back panel 24 from the top panel 28. In an example embodiment, a tuck panel 30 is on an end of the top panel 28, where a twelfth fold line 110 divides the top panel 28 from the tuck panel 30. In an example embodiment, the tuck panel 30 includes curved corner edges 30*a* and a flat end edge 30*b*. While top panel 28 is shown connected to back panel 24, other embodiments could include top panel 28 connected to one of the side panels 20 or 22, or to the front panel 12.

In an example embodiment, the blank 1 includes a first dust panel 32 and a second dust panel 34 connected to top edges of the first side panel 20 and the second side panel 22, respectively, where a thirteenth fold line 112 divides the first side panel 20 from the first dust panel 32, and fourteenth fold line 114 divides the second side panel 22 from the second dust panel 24. In an example embodiment, the first dust panel 32 and/or the second dust panel 34 can include a side edge 32*a* that is sloped. In the example of FIG. 5, both dust panels 32/34 include a sloped side edge, but in some example embodiments, the dust panels 32/34 do not include sloped side edges, or only one of the dust panels could include a sloped side edge. While dust panels 32/34 are shown connected to side panels 20/22, respectively, other example embodiments may include dust panels 32/34 connected to different panels (e.g., to panels 24 and 12, for example, if top panel 28 were connected to the first side panel 20 or the second side panel 22).

In an example embodiment, a top edge of the blank 1 defines a cut-out 12*b*. In an example embodiment, the cut-out is on the top edge of front panel 12. In other embodiments, a cut-out 12*b* could be on the top edge of another panel (e.g., panel 24 if top panel 28 were connected to front panel 12, the first side panel 20 if top panel 28 were connected to the second side panel 22, or the second side panel 22 if top panel 28 were connected to the first side panel 20). In an example embodiment, the cut-out 12*b* is arcuate shaped.

Figure 6:
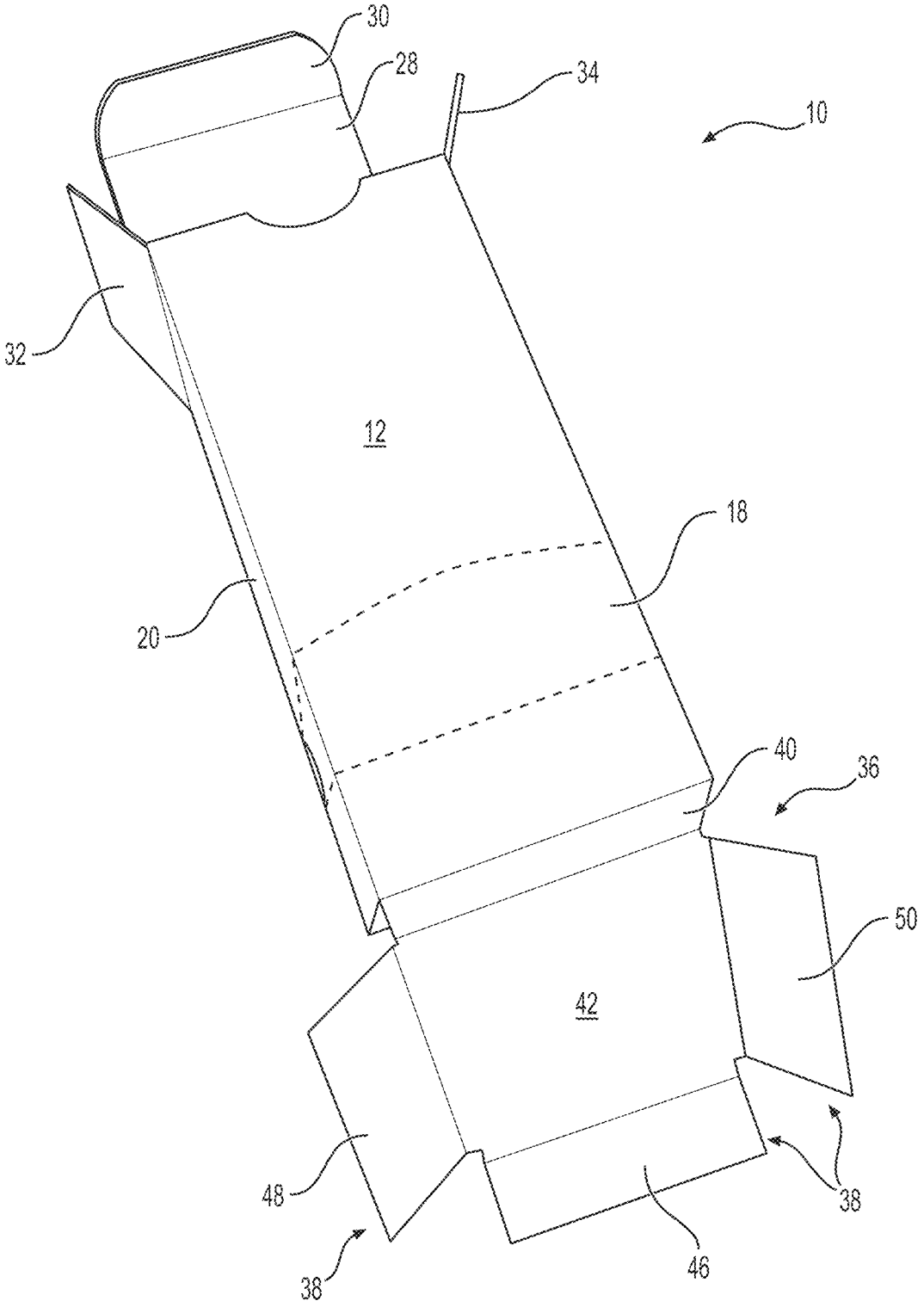
FIG. 6 is an illustration of a front perspective view of a package in a partially assembled configuration, in accordance with an example embodiment.
Figure 10:
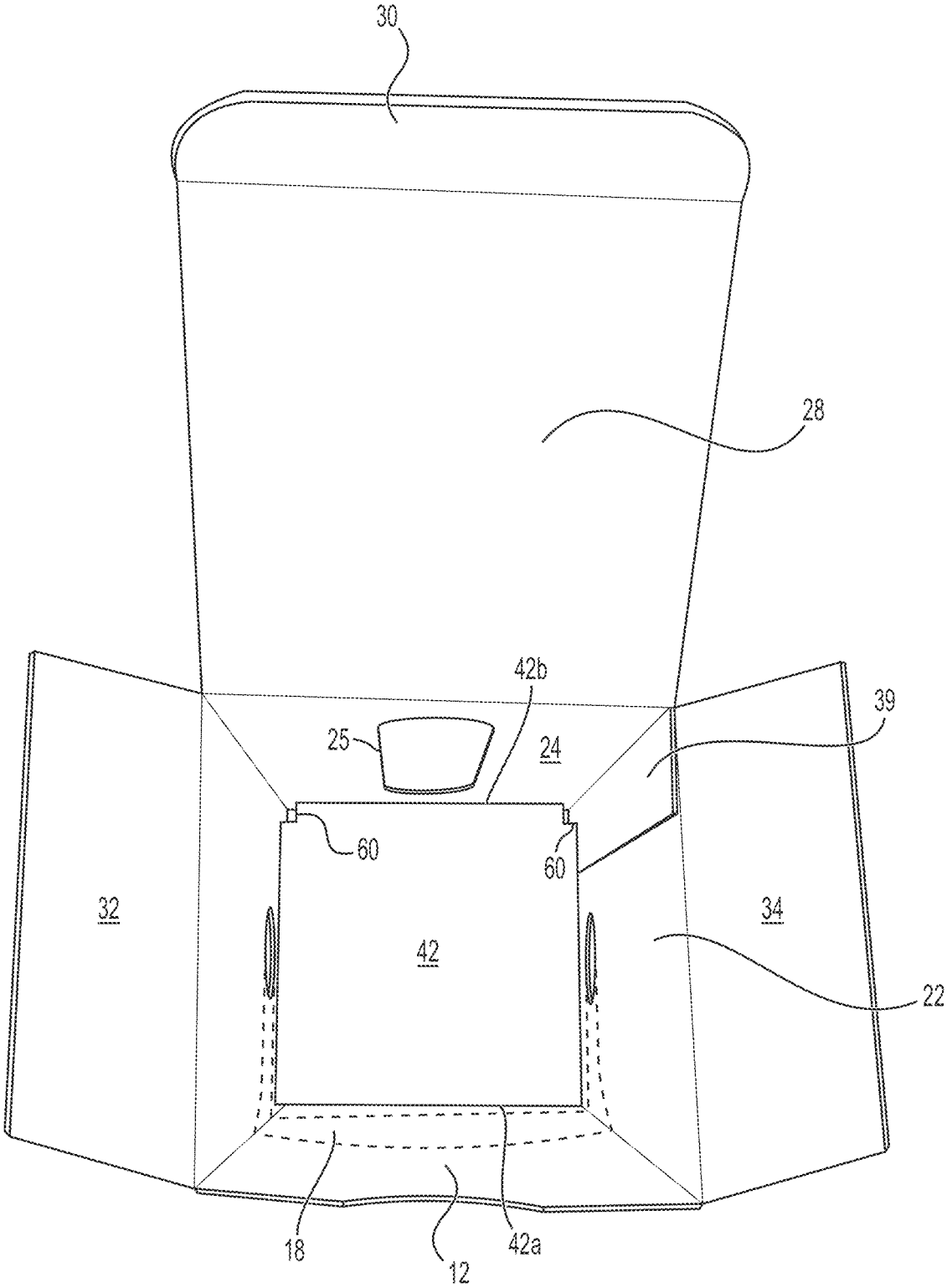
FIG. 10 is an illustration of a top view of an opened package, in accordance with an example embodiment.

FIG. 6 is an illustration of a front perspective view of a package 10 in a partially assembled configuration, in accordance with an example embodiment, where the package 10 is partially assembled by adhering the first glue panel 39 to an inner surface of the second side panel 22 (as shown in better detail in FIG. 10). FIG. 6 also shows platform panel 42, and foot panels 40, 46, 48 and 50 not yet being folded to complete the formation of package 10. In this configuration, top panel 28 has not yet been closed, and therefore a top end of the package 10 remains open.

FIG. 7 is an illustration of a bottom/front perspective view of a package 10 in a partially assembled configuration, in accordance with an example embodiment. In this configuration, and in an example embodiment, platform panel 42, and foot panels 40, 46, 48 and 50 have been folded and inserted into the bottom end of the package 10. In this configuration, and in an example embodiment, the foot panel 46 overlays the tab 21 (mostly obscured from view, other than a lower portion of cut line 23*a* and the ninth fold line 23*b*).

Figure 8:
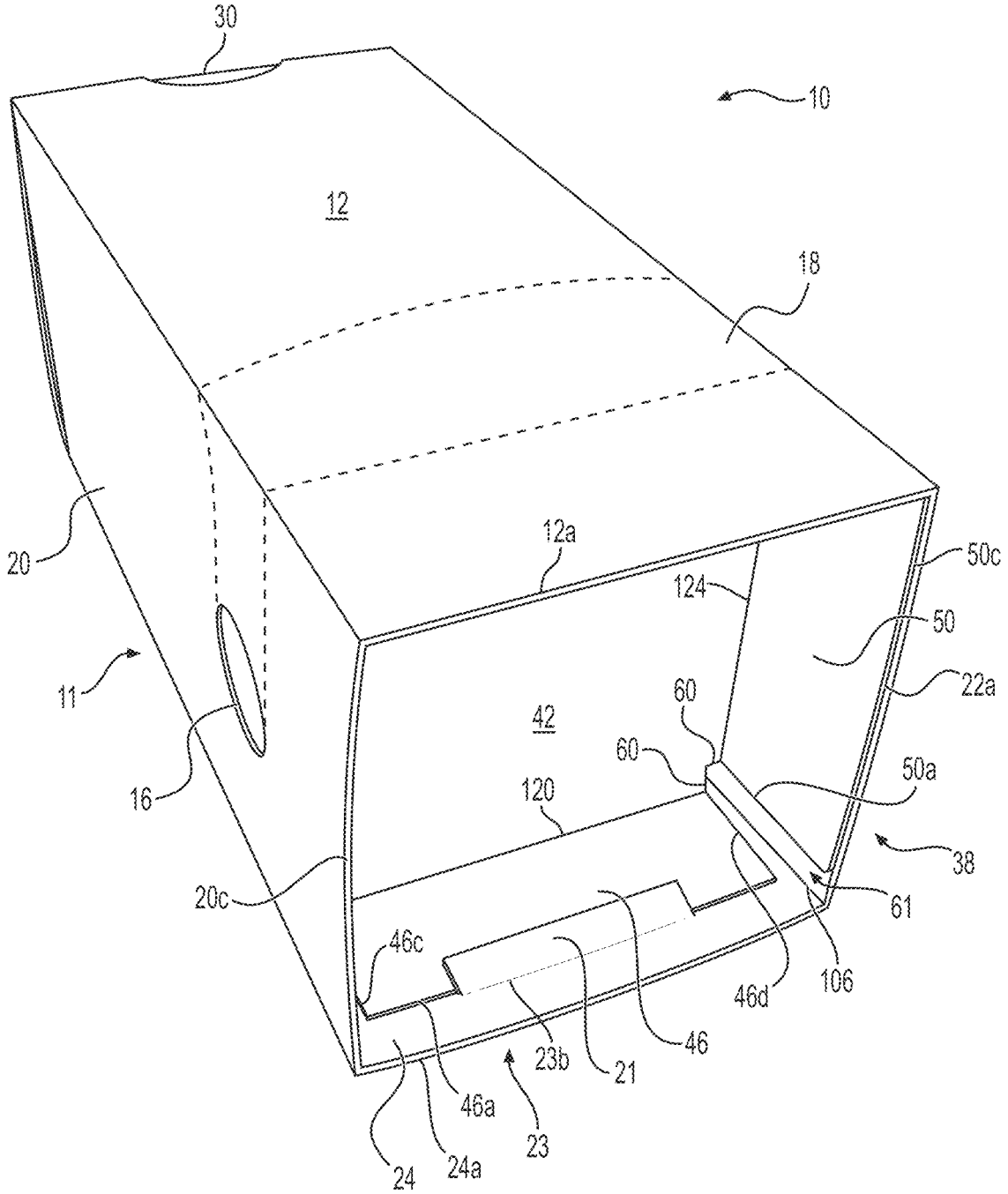
FIG. 8 is an illustration of a bottom/front perspective view of a package in an assembled configuration, in accordance with an example embodiment.

In an example embodiment, and as discussed above, the platform panel 42 can include one or more cut-outs 60 (in the example shown in FIGS. 5 and 10 there are two cut-outs 60, but only one is seen in the views shown in FIGS. 7 and 8). In an example embodiment, a cut-out 60 causes a gap 61 to exist between at least some of the foot panels, such as the gap 61 that is shown in FIG. 7 between the first end 50*a* of the fourth foot panel 50 and the second end 46*d* of the second foot panel 46, as shown in FIG. 7. In an example embodiment, and in this configuration, the at least one top panel 28 is in a closed position and the tuck panel 30 is tucked into the package (as can be seen through the cut-out 12*b* in FIG. 7).

Figure 9:
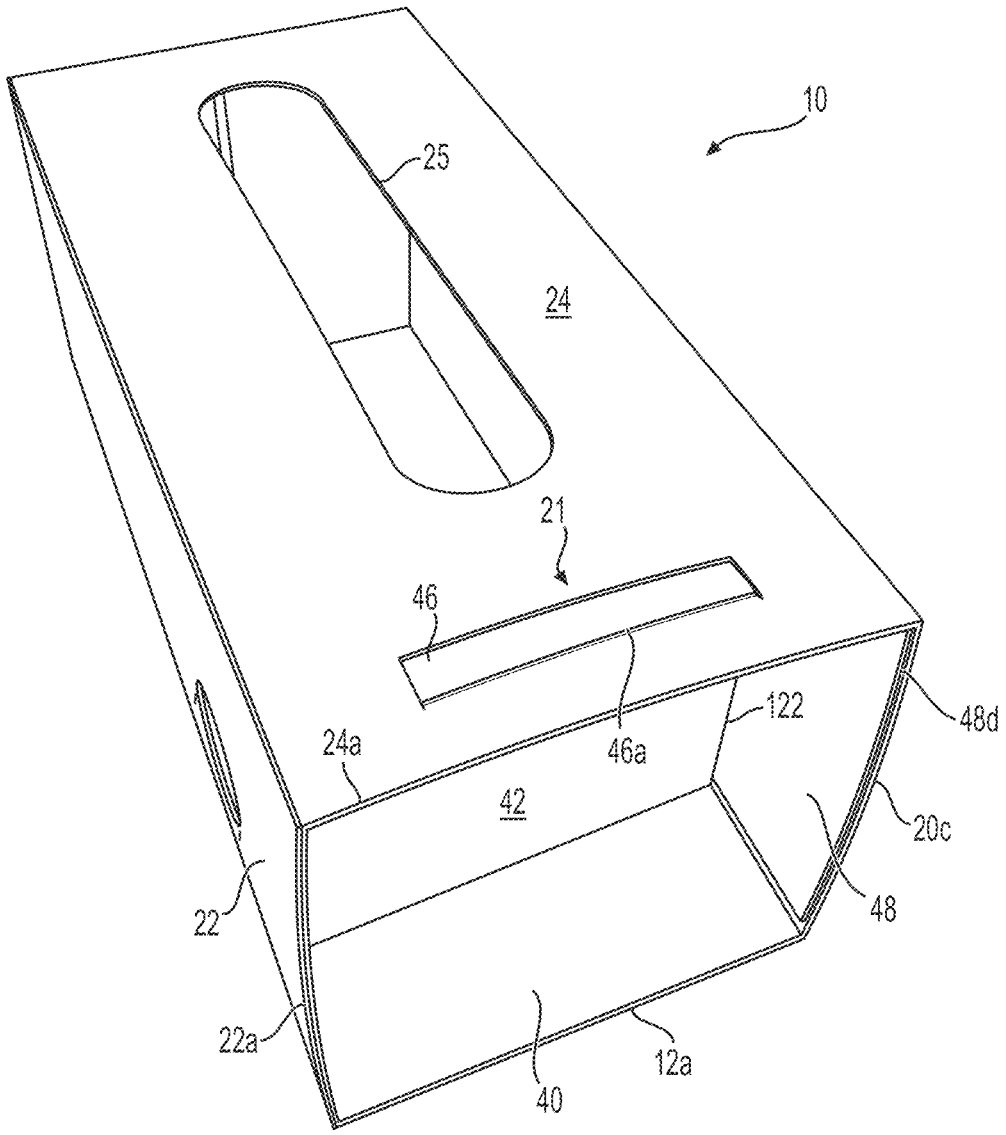
FIG. 9 is an illustration of a bottom/rear perspective view of a package in the assembled configuration, in accordance with an example embodiment.

FIG. 8 is an illustration of a bottom/front perspective view of the package 10 in an assembled configuration, in accordance with an example embodiment. In this configuration, and in an example embodiment, the bottom edge 46*a* of the second foot panel 46 is being retained by the tab 21 (as shown in FIG. 8 and also in FIG. 9). In an example embodiment, by retaining second foot panel 46 by the tab 21, and given that platform panel 42 is connected to foot panel 40 (as shown in FIG. 9) and to foot panel 46, the platform panel 42 is supported and is able to hold one or more consumer items 200 (as shown, for example, in FIGS. 11 and 12).

Figure 11:
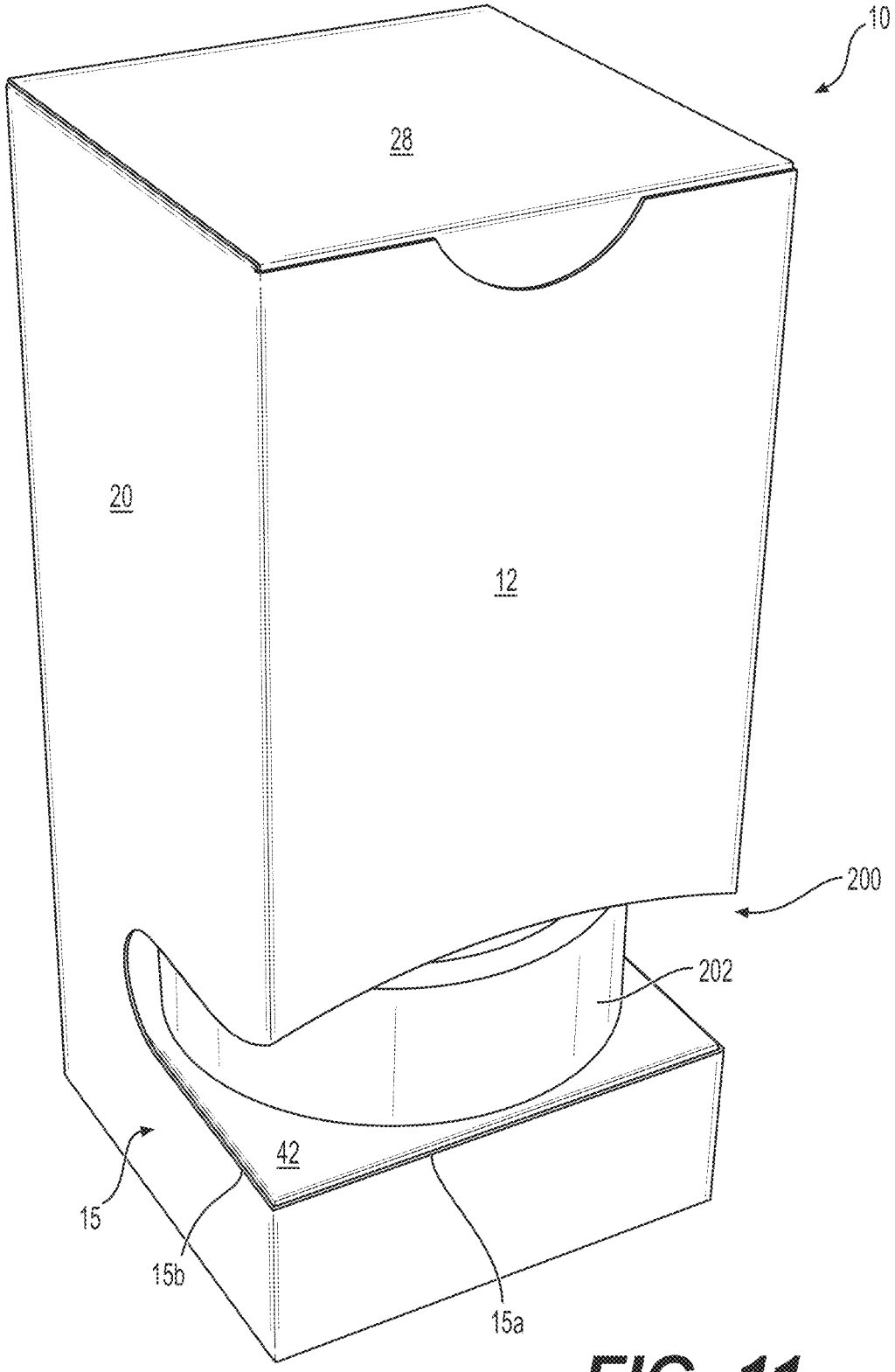
FIG. 11 is an illustration of a front perspective view of a package, with the tear-off section torn off and one or more consumer items in the package, in accordance with an example embodiment.

In an example embodiment, one or more of the foot panels (e.g., 40, 46, 48, 50) at least partially support the platform panel 42. Some example embodiments may include less foot panels than as shown in the figures. For example, an example embodiment may include foot panel 40 and platform 42, and platform 42 may be adhered to back panel 24 when blank 1 is folded to form a package 10, and blank 1 may omit tab 21 and foot panels 46, 48, 50. Another example embodiment may include foot panel 40, platform 42, and foot panel 46, but may omit foot panels 48 and 50. Other suitable variations may be used. In an example embodiment, one or more of the foot panels (e.g., 40, 48 and/or 50) extend to a lowest edge of package 10 when blank 1 is folded into package 10, such that an edge of one or more of the foot panels that extend to the lowest edge directly contacts a surface, if a bottom of the package 10 is placed on the surface to dispense consumer items (e.g., as shown in FIG. 11, with top panel 28 at the top of package 10). In an example embodiment, one or more of the foot panels, or portions of the one or more foot panels, or weight-bearing portions of the one or more foot panels, have surfaces that are substantially parallel with gravity, or normal with a surface, if the package 10 is placed on the surface in a dispensing orientation. In an example embodiment, a lower edge of a pair of opposing foot panels extend to a lowest-most elevation of the package 10. In an example embodiment, an end edge (lower edge) 50*c* of the fourth foot panel 50, and an end edge (lower edge) 48*d* of the third foot panel 48, extend to a lowest-most elevation of the package 10, such that the end edge 50*c* and end edge 48*d* are about flush with a bottom edge of the side panels 20/22, when blank 1 is folded into a package 10. In an example embodiment, a bottom edge of the sidewalls 11 include: end edge 12*a* of the front panel 12, end edge 24*a* of the back panel 24, end edge 20*c* of the first side panel 20 and end edge 22*a* of the second side panel 22. In an example embodiment, a height of the fourth foot panel 50 (from the fifth fold line 124 to the end edge 50*c* when blank 1 is folded into a package 10, as shown in FIG. 8), and a height of the third foot panel 48 (from the fourth fold line 122 to the end edge 48*d* when blank 1 is folded into a package 10, as shown in FIG. 9), are each longer than a height of the second foot panel 46 (from the third fold line 120 to the bottom edge 46*a* when blank 1 is folded into a package 10, as shown in FIG. 8).

In an example embodiment, the platform panel 42 forms a bottom surface of the package 10. In an example embodiment, a combination of the platform panel 42 and the one or more foot panels forms a "false bottom" structure, or a "raised platform" structure, at the lower end of the package 10. In an example embodiment, the package 10 includes a flat bottom-most surface (not shown) that covers and conceals the platform panels 42 and the one or more foot panels from a bottom view of the package 10.

In example embodiments of a package 10, a first foot panel 40 extends along an inner surface of the front panel 12, without being adhesively connected to the front panel 12, a second foot panel 46 extends along an inner surface of the back panel 24, without being adhesively connected to the back panel 24, a third foot panel 48 extends along an inner surface of a side panel 20, without being adhesively connected to the side panel 20, and/or a fourth foot panel 50 extends along an inner surface of a side panel 22, without being adhesively connected to the side panel 22. In example embodiments of a package 10, the one or more foot panels may be adhered to the respective front, back and/or side panels.

FIG. 9 is an illustration of a bottom/rear perspective view of a package 10 in an assembled configuration, in accordance with an example embodiment. In an example embodiment, and as discussed above, the bottom edge 46*a* of a second foot panel 46 is retained in the tab 21, in order to allow the second foot panel 46 to support the platform panel 42.

FIG. 10 is an illustration of a top view of a package 10 in an opened configuration, in accordance with an example embodiment. In this configuration, and in an example embodiment, the top panel 28 is opened, allowing access to an inside of the package 10, and allowing the package 10 to be filled, for instance, with consumer items. In this configuration, and in an example embodiment, cut-outs 60 can be seen on corners of the platform panel 42. In this configuration, and in an example embodiment, a first glue panel 39 can be seen adhered to the second side panel 22. In an example embodiment, the first glue panel 39 and the second side panel 22 are the only panels of the package 10 that are adhesively connected together to form the package. Other example embodiments may include adhesive between additional panels, or adhering additional panels together for extra rigidity.

FIG. 11 is an illustration of a front perspective view of a package 10, with tear-off section 18 removed, and one or more consumer items 200 being displayed within the opening 15, in accordance with an example embodiment. In an example embodiment, a bottom-most consumer item 202 is visible in the opening 15, from a front vantage point and a side vantage point of the package 10. In an example embodiment, the bottom-most consumer item 202 is supported by platform panel 42, where the platform panel 42 is about flush with, or higher than, the front/lower edge 15*a* and the lower side edge 15*b* of the opening 15. In an example embodiment, the opening 15 is sized to allow only one consumer item 202 to be removed from the package 10 at a time. In an example embodiment, the opening 15 is sized to allow two or more consumer items 202 to be removed from the package 10 at a time. In an example embodiment, the consumer items 200 are cans containing a tobacco product, such as moist smokeless tobacco, tobacco pouches, or any other type of tobacco products. Packages 10 may also be used for any other types of products.

Figure 12:
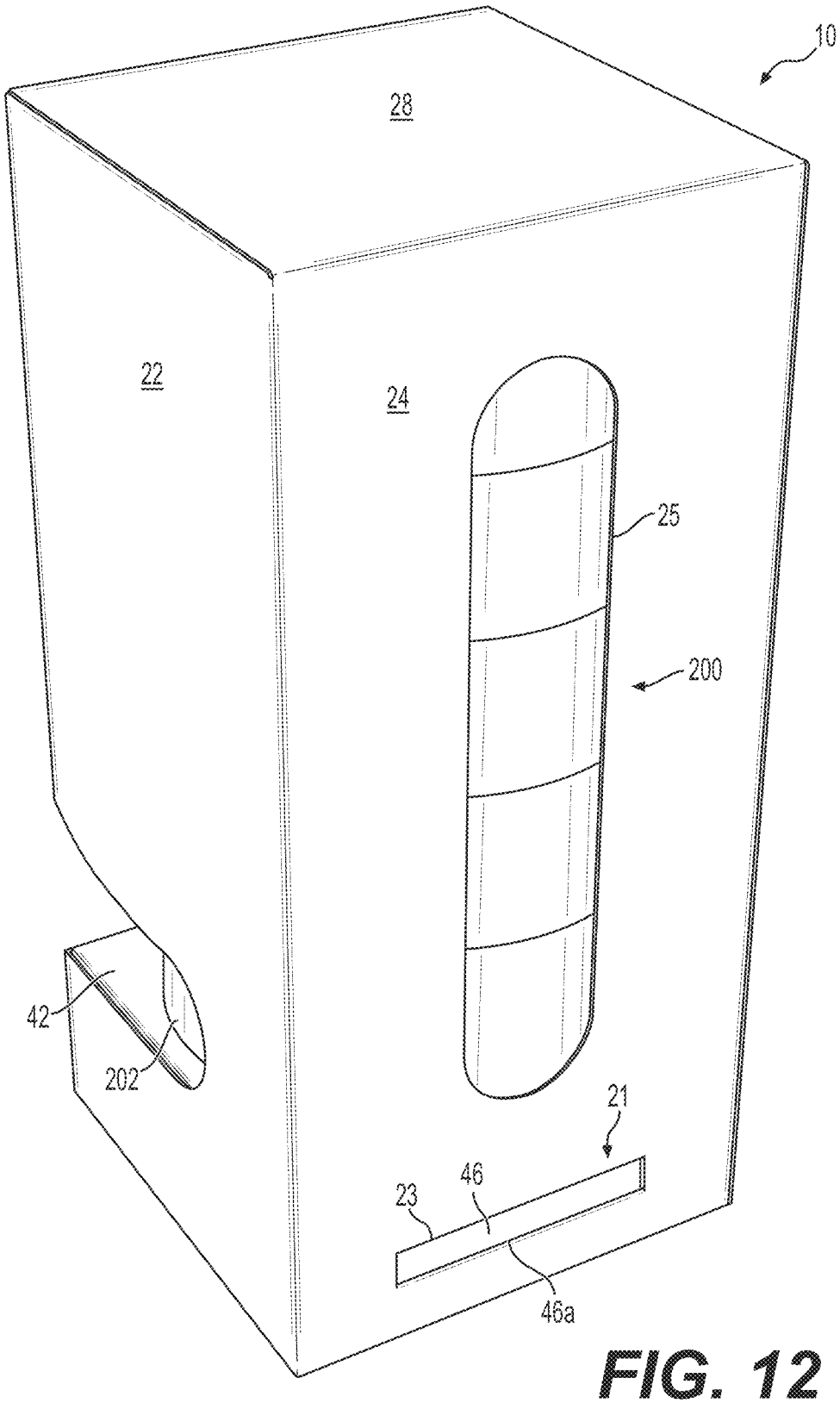
FIG. 12 is an illustration of rear front perspective view of a package, with the tear-off section torn off and the one or more consumer items in the package, in accordance with an example embodiment.

FIG. 12 is an illustration of rear front perspective view of the package 10, with the tear-off section 18 removed, in accordance with an example embodiment. In an example embodiment, one or more consumer items 200 are visible through window 25. In an example embodiment, window 25 may be large enough to visually verify the overall capacity of consumer items 200 within a package 10, although other embodiments may include a smaller window 25, and some embodiments may not include a window 25.

In an example embodiment, the package 10 is loadable, or reloadable. That is to say, consumer items 200 can be loaded, or re-loaded, into the package 10 so that the package 10 can dispense consumer items 200. In an example embodiment, consumer items 200 can be loaded, or re-loaded, into the package 10, for example, from the top of the package 10 by opening top panel 28.

Figure 13:
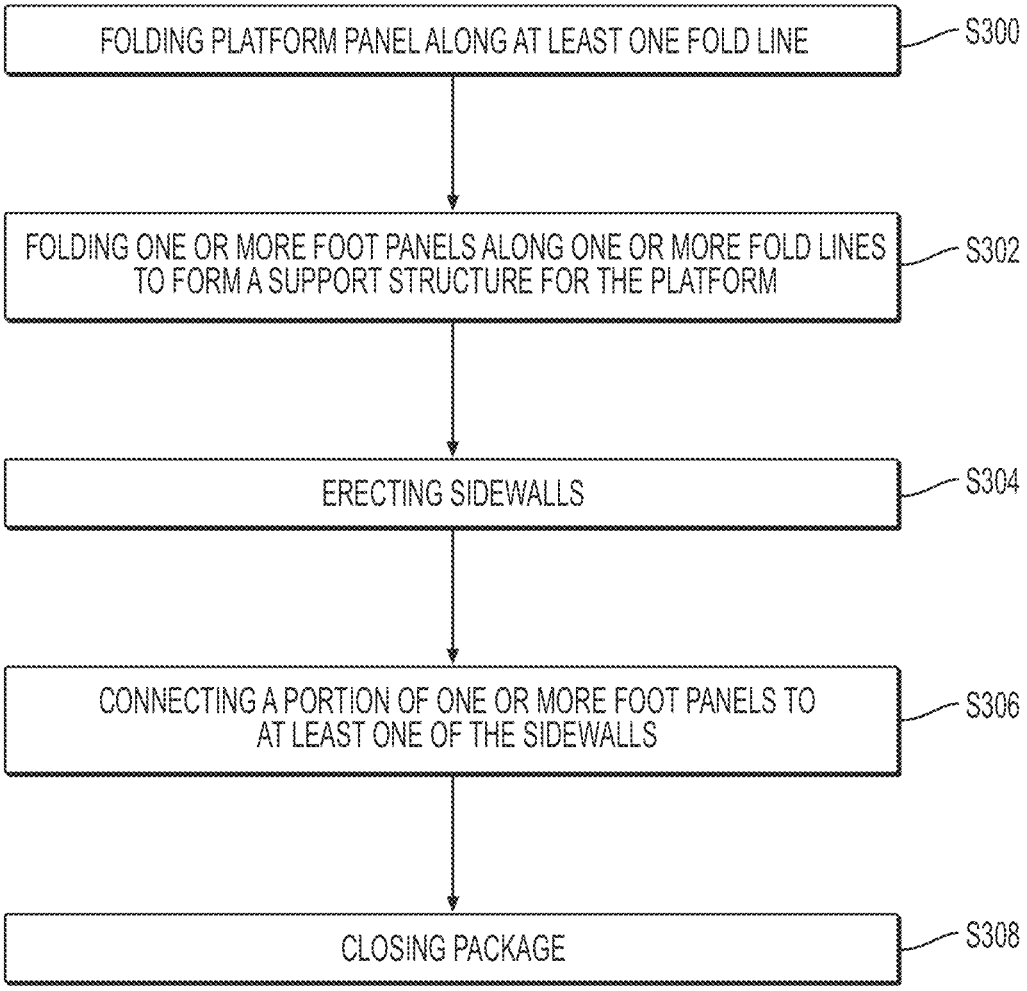
FIG. 13 is a flowchart of a method of forming a package from a blank, in accordance with an example embodiment.

FIG. 13 is a flowchart of a method of forming a package 10 from a blank 1, in accordance with an example embodiment. In an example embodiment, the method includes, in step S300, folding a platform panel 42 along at least one fold line to form a platform. In an example embodiment, the method includes, in step S302, folding one or more foot panels (e.g., 40, 46, 48 and/or 50) along one or more additional fold lines to form a support structure for the platform. In an example embodiment, the method includes, in step S304, folding panels 12, 20, 22, 24 and 39 along fold lines, and adhering glue panel 39 to side panel 22, to erect sidewalls. In an example embodiment, the method includes, in step S306, connecting a portion of one or more of the one or more foot panels to at least one of the sidewalls 11. In an example embodiment, this is accomplished by fitting the bottom edge 46*a* of a second foot panel 46 between a tab 21 and back panel 24, so that a bottom edge 46*a* of second foot panel 46 is retained by the tab 21 (see at least FIG. 8). In an example embodiment, the second foot panel 46 can be adhesively connected to the back panel 24, in addition, or as an alternative, to the bottom edge 46*a* being retained by a tab 21. In an example embodiment, more than one foot panel can be included and connected to more than one of the sidewalls 11, either through tabs, adhesives, or other suitable mechanisms. In an example embodiment, a foot panel is connected to at least one of the sidewalls 11 without any use of an adhesive. In an example embodiment, the method includes, in step S308, folding a top panel 28 and tuck panel 30 along fold lines to close package 10. The example method steps can be performed in a different order.

In an example embodiment, the blank 1 and/or the package 10 are formed of material or materials that can include cardboard, paperboard, paper, pulp, cellulose, plastic, polymer, foil, metal, any other suitable material, or any combination thereof.

In the example embodiments described here, elements or panels that are adhesively connected to each other can be adhered via an adhesive, tape, pressure sensitive tape, glue, paste, rubber cement, mucilage, gum, a polymer, any other suitable adhesive, or any combination thereof Example embodiments having thus been described, it will be obvious that the same may be varied and modified in many ways. Such variations and modifications are intended to be included within the scope of the following claims.

What is claimed is:

1. A method using a blank, the blank including sidewall panels, a first foot panel connected to a first one of the sidewall panels, a platform panel connected to the first foot panel, and a second foot panel connected to the platform panel, the method comprising:

first folding the sidewall panels and connecting respective side edges of the sidewall panels to form sidewalls of a package;

second folding the platform panel to fit within a first end of the sidewalls so that first major surfaces of the first foot panel and the second foot panel each at least partially press against a respective one of the sidewalls; and connecting the second foot panel to one of the sidewalls to stabilize the platform panel within the first end.

2. The method of claim 1, wherein the connecting of the second foot panel includes retaining a first distal end of the second foot panel using a tab on a back panel of the sidewalls so that the platform panel is resisted from sliding out of the first end.

3. The method of claim 1, further comprising:

inserting at least one consumer item into a first opening defined by a second end of the sidewalls, the at least one consumer item being supported on the platform panel when the package is in an upright position.

4. The method of claim 1, further comprising:

inserting a stack of cylindrical canisters into a first opening defined by a second end of the sidewalls, the stack of cylindrical canisters being supported by the platform panel when the package is in an upright position.

5. The method of claim 4, wherein the blank defines a tear-off section that extends across at least a portion of one or more of the sidewalls, the method further comprising:

tearing away the tear-off section to expose a second opening; and dispensing the stack of cylindrical canisters, one canister at a time from a bottom of the stack of cylindrical canisters, through the second opening.

6. The method of claim 1, wherein the blank defines a tear-off section that extends across at least a portion of one or more of the sidewalls, the method further comprising:

tearing away the tear-off section to expose a second opening, the second opening being configured to allow at least one consumer item to be dispensed from the package through the second opening.

7. The method of claim 1, wherein the blank defines a tear-off section that extends across a portion of one or more of the sidewalls adjacent to the platform panel, the method further comprising:

tearing away the tear-off section to expose a second opening, the second opening being configured to allow a lowest canister of a stack of cylindrical canisters, to be dispensed from the package through the second opening, the stack of cylindrical canisters being supported by the platform panel.

8. The method of claim 1, wherein the blank defines a tear-off section that extends across a portion of one or more of the sidewalls adjacent to the platform panel, the method further comprising:

tearing away the tear-off section to expose a second opening, a stack of cylindrical canisters being supported by the platform panel, the second opening being configured to allow a lowest canister of the stack of cylindrical canisters, to be viewed by at least three sides of the package while being supported by the platform panel.

9. The method of claim 1, wherein the blank further includes a third foot panel and a fourth foot panel connected to opposing sides of the platform panel, the second folding further including folding the third foot panel and the fourth foot panel so that a respective distal end edge of the third foot panel and the fourth foot panel are aligned with a respective lowest edge of the first end of the sidewalls.

10. The method of claim 1, wherein the blank further includes a third foot panel and a fourth foot panel connected to opposing sides of the platform panel, the first foot panel and the second foot panel also being on opposing sides of the platform panel, the second folding further including folding the third foot panel and the fourth foot panel so that a respective distal end edge of the third foot panel and the fourth foot panel are aligned with a respective lowest edge of the first end of the sidewalls, a fold line connecting the first foot panel to the first one of the sidewalls panels, the fold line partially forming a portion of the lowest edge.

11. The method of claim 1, wherein the blank further includes a third foot panel and a fourth foot panel connected to opposing sides of the platform panel, the first foot panel and the second foot panel also being on opposing sides of the platform panel, the second folding further including folding the third foot panel and the fourth foot panel so that a respective distal end edge of the third foot panel and the fourth foot panel are aligned with a respective lowest edge of the first end of the sidewalls, the lowest edge of the first end of the sidewalls being in a common plane.

12. The method of claim 1, wherein the blank further includes at least one top panel connected to at least one of the sidewall panels, the method further comprising:

third folding the at least one top panel to close a second end of the sidewalls of the package, the first end and the second end being on opposing ends of the package.

13. The method of claim 1, wherein the blank further includes at least one top panel and at least two dust panels respectively connected to at least one of the sidewall panels, the method further comprising:

third folding the at least one top panel and the at least two dust panels to close a second end of the sidewalls of the package, the first end and the second end being on opposing ends of the package.

14. The method of claim 1, wherein the second folding causes the platform panel to at least partially close the first end.

15. The method of claim 1, wherein the second folding folds the platform panel so that the fist major surfaces of the first foot panel and the second foot panel respectively press against a first sidewall and a second sidewall, of the sidewalls of the package.

16. The method of claim 1, wherein the second folding folds the platform panel such that second major surfaces of the platform panel are perpendicular to the sidewalls once the package is assembled.

17. The method of claim 1, wherein the second folding folds the platform panel such that the platform panel forms a false bottom where the platform panel is raised to an elevation that is above a distal-most bottom elevation of the package, once the package is assembled and is in an upright position.

18. A method using a blank, the blank including sidewall panels, a first foot panel connected to a first one of the sidewall panels, a platform panel connected to the first foot panel, and a second foot panel connected to the platform panel, the method comprising:

first folding the sidewall panels and connecting respective side edges of the sidewall panels to form sidewalls of a package;

second folding the platform panel to fit within a first end of the sidewalls so that the first foot panel and the second foot panel each at least partially press against a respective one of the sidewalls; and connecting the second foot panel to one of the sidewalls to stabilize the platform panel within the first end, the connecting includes connecting a first distal end of the second foot panel to a back panel of the sidewalls.

19. A method using a blank, the blank including sidewall panels, a first foot panel connected to a first one of the sidewall panels, a platform panel connected to the first foot panel, and a second foot panel connected to the platform panel, the method comprising:

first folding the sidewall panels and connecting respective side edges of the sidewall panels to form sidewalls of a package;

second folding the platform panel to fit within a first end of the sidewalls so that the first foot panel and the second foot panel each at least partially press against a respective one of the sidewalls; and connecting the second foot panel to one of the sidewalls to stabilize the platform panel within the first end, the connecting including retaining a first distal end of the second foot panel using a tab on a back panel of the sidewalls.

* * * * *